US005706899A

United States Patent [19]

Klebanov et al.

[11] Patent Number: 5,706,899

[45] Date of Patent: Jan. 13, 1998

[54] MINE EXTRACTOR APPARATUS

[75] Inventors: Boris Klebanov; Abraham Hyams, both of Beer-Sheva, Israel

[73] Assignee: Israel Aircraft Industries, Ltd., Beer-Sheva, Israel

[21] Appl. No.: 575,559

[22] Filed: Dec. 20, 1995

[30] Foreign Application Priority Data

Dec. 22, 1994 [IL] Israel ..... 112119

[51] Int. Cl.[6] ..... A01B 43/00; F41H 11/12

[52] U.S. Cl. ..... 171/141; 171/63; 89/1.13

[58] Field of Search ..... 37/105, 106, 107; 89/1.13, 1.14, 36.08; 56/400; 171/63, 64, 65, 141, 142

[56] References Cited

U.S. PATENT DOCUMENTS

| | | | |
|---|---|---|---|
| 2,460,322 | 2/1949 | Walker | 89/1 |
| 4,270,614 | 6/1981 | Judy | 171/63 |
| 4,552,053 | 11/1985 | Bar-Nefy et al. | 171/141 X |
| 4,667,564 | 5/1987 | Schreckenberg . | |
| 5,291,819 | 3/1994 | Hambric | 171/141 X |
| 5,373,774 | 12/1994 | Akbar | 171/141 X |

FOREIGN PATENT DOCUMENTS

| | | |
|---|---|---|
| 313 964 | 2/1974 | Austria . |
| 0 300 254 | 1/1989 | European Pat. Off. . |
| 1157301 | 5/1958 | France . |
| 2065235 | 10/1970 | France . |
| 1960172 | 1/1971 | Germany . |
| 34 33 186 | 3/1986 | Germany . |
| 34 33 217 | 3/1986 | Germany . |
| 1098690 | 1/1968 | United Kingdom . |
| 2155866 | 10/1985 | United Kingdom . |

*Primary Examiner*—Terry Lee Melius
*Assistant Examiner*—Robert Pezzuto
*Attorney, Agent, or Firm*—Merchant, Gould, Smith, Edell, Welter & Schmidt, P.A.

[57] ABSTRACT

A mine extractor for removing buried mines having a plurality of leaf springs disposed in parallel side by side relationship and mounted on a common support. The extractor further comprises adjacent auxiliary springs and thereby forming additional batteries, a slide attached to the springs and adapted to slide on its bottom on the ground and/or an apparatus for swinging a beam and the slide with respect to a base to lift the slide from the ground.

19 Claims, 5 Drawing Sheets

MINE EXTRACTOR APPARATUS

FIELD OF THE INVENTION

This invention relates to apparatus for extracting mines from the ground, particularly apparatus that is adapted to be mounted on the front of military or non-military vehicles, which apparatus is particularly suited to extracting mines that have been laid on the ground surface in hollows or craters of the ground.

BACKGROUND OF THE INVENTION

In-line mine extractors are known in the art and currently used for military or, as the case may be, civil purposes. They are typically constituted by an array of tines carried by a frame, which is adapted to be attached to the front of a vehicle, be it a tank or a different kind of military or non-military vehicle, springs being provided between the frame and the flat fingers to urge their tips towards the soil while permitting them to ride over soil projections or irregularities.

It has been found, however, that these mine extractors are not adequately operative to extract mines that are laid in hollows or craters of the soil. The flat fingers are unable satisfactorily to engage such mines or, if they engage them, to extract them from the hollow in which they lie.

It is therefore a purpose of this invention to provide such an in-line mine extractor that is able to deal satisfactorily with mines that are laid in hollows or craters on the surface of the ground.

It is another purpose of this invention to provide a mine extractor apparatus which can be mounted on the front of a vehicle and is able to engage mines that are laid in hollows or craters of the ground and to extract them from said hollow or crater.

It is a further purpose of this invention to provide such a mine extractor apparatus that is simple and sturdy and economical to make.

It is a still further purpose of the invention to provide such a mine extractor apparatus that can be rendered inoperative to permit the vehicle which carries it freely to advance over any terrain.

Other purposes and advantages of the invention will appear as the description proceeds.

SUMMARY OF THE INVENTION

The mine extractor according to the invention is characterized in that it comprises at least one plurality of leaf springs, attached to a frame that can be mounted in front of the vehicle, which leaf springs are so formed and mounted as to ride with their tips over the ground. Preferably, the leaf springs are bent at an angle towards the ground. More preferably, said angle is close to a right angle or even is substantially a right angle More specifically, said leaf springs have a rear portion which is attached to said frame, and a front portion, set at substantially at a right angle or close to a right angle with respect to said first portion. Preferably, when the mine extractor is operating, said first portion is substantially horizontal or subhorizontal and said second portion is substantially vertical or subvertical and downwardly directed. Also, preferably, elastic means, e.g. spiral springs, are interposed between said leaf springs and the frame which supports them, to permit an amount of elastic oscillation of said springs with respect to the frame and to the ground.

Also, preferably, means are provided for said springs from swinging downwards above a certain angle. In a preferred embodiment, deflector plates are pivoted to the said leaf springs about the portion thereof at which they are bent at an angle, and are adapted to swing upwards if soil accumulates in front of the leaf spring, to prevent it from spilling over them.

In a preferred form of the invention, said frame comprises a base, attached to the vehicle, a beam pivotally connected to said base, and a slide pivotally connected to said beam and connected to the leaf springs in such a manner as to permit an amount of oscillation of said springs with respect to said slide, elastic means being more preferably provided elastically to react to said oscillations.

Preferably, the leaf springs are arranged in batteries of any convenient number, e.g. 8–10 leaf springs, disposed parallel and side-by-side to one another, and mounted on a common frame. Various such batteries may be attached to the same vehicle and may be disposed in the same direction or at an angle to one another, or partly in the same direction and partly at an angle to one another. All batteries may be mounted and provided with the mechanical elements and cooperating parts and arrangements that have been or will be described with respect to a single battery.

In a preferred form of the invention means are provided for swinging the beam and the slide, that are part of the frame, from an operative position, in which the leaf springs contact the ground, and an inoperative position in which all the leaf springs and attached mechanical elements are raised out of contact with the ground and do not interfere with the progress of the vehicle.

DETAILED DESCRIPTION OF PREFERRED EMBODIMENTS

Figure 1:
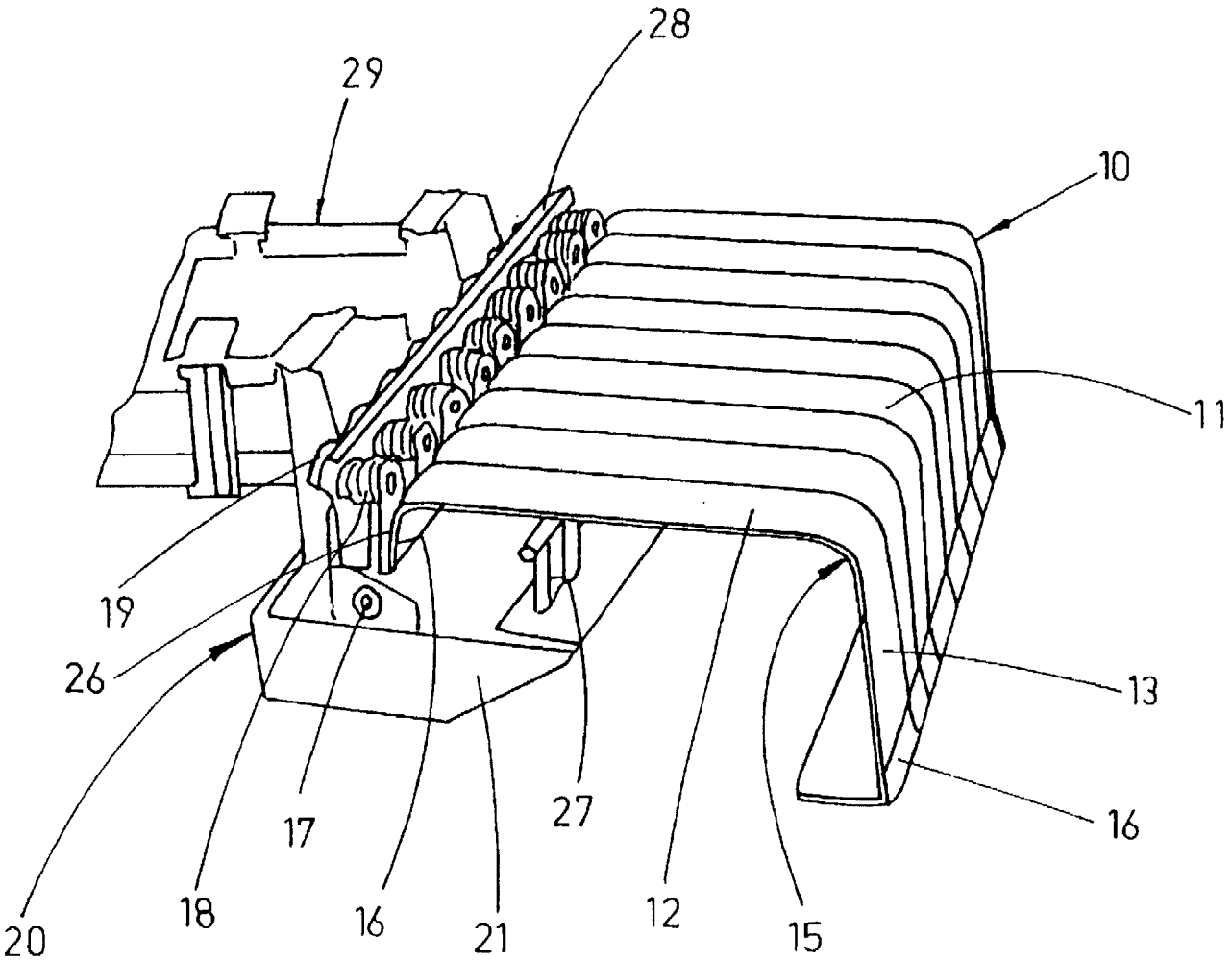
FIG. 1 is a schematic perspective view of a battery of leaf springs, seen from the side at an angle of about 45° from the vertical, the supporting frame being only partially shown.

With reference now to FIG. 1, numeral 10 generally designates a battery of leaf springs 11, according to an embodiment of the invention, in the number of nine. Each leaf spring 11 comprises a rear subhorizontal portion 12 and a front subvertical portion 13. Between the two, the leaf spring is bent at a substantially right angle, but preferably not with a sharp bend, but with a certain bending radius, as indicated by arrow 15. At its foremost and lowermost portion, viz. at its tip, each leaf spring and, more specifically, each subvertical portion 13 thereof, is preferably provided with a shoe 14, attached hereto by any convenient means, which shoe extends to the rear of the leaf spring and has the purpose of permitting each leaf spring 11 to slide with its tip on the ground without undue wear and tear.

At its rearmost end, each leaf spring is attached to the frame which supports it. For this purpose, in this embodiment, the leaf spring is once again bent downwards to provide a terminal 16, which is pivoted to a bar 17, perpendicular to the orientation of the leaf springs and fixed to a slide 20. Slide 20 is adapted to slide with its bottom on the ground and may be of any suitable structure. In the embodiment illustrated, it is provided with vertical stop-plates 27, the purpose of which is to prevent the leaf springs 11 from swinging downwards with respect to slide 20 by more than a certain angle. Each terminal 16 is attached, e.g. by means of bolts or in any convenient manner, to a plate 26, which bears on the forward end of a helical spring 18, the rear end of which bears on a cup-like stopper 19, all the stoppers 19 being mounted on plate 28, fixed to slide 20 and provided with apertures through which the springs 18 can pass. By means of this construction, the leaf springs are allowed an amount of elastic oscillation about bar 17 with respect to slide 20. Slide 20 is attached to a beam 29, which is pivotally connected e.g. at 30 to a base 31(see FIG. 2). Base 31 is structured in such a way as to be adapted to the vehicle which supports the mine extractor apparatus and is rigidly attached by any convenient means, e.g. through brackets 32, to the forward end of the supporting vehicle, or to structural elements fixed to said forward end, generally indicated at 33. Said vehicle can be of any kind, e.g. a military vehicle, such as a tank or an armored car or the like, or a non-military vehicle. Slide 20, beam 29 and base 31 together constitute the frame which supports the leaf spring battery.

When desired, slide 20 and beam 29, with said leaf spring battery 10 and related mechanical parts, can be rotated upwards, and thus the mine extractor may be disengaged from the ground to permit free travel of the supporting vehicle. For this purpose, lifting means, e.g. hydraulic means, which in the embodiment described comprise cylinder 40 attached to base 31, a piston attached to piston rod 41 and links 42–43, can be actuated to swing slide 20 and beam 29, clockwise, if the apparatus is seen as in FIGS. 2 and 4, about pivot 30, by displacing piston rod 41 and its piston to the right, if the apparatus is seen as in FIGS. 2 and 4. When the beam has reached the position shown in FIG. 4, pin 44 will snap into travel lock 45 and secure the beam. At this point, a torque actuator, viz. a small motor, schematically indicated at 47, will rotate the shoe 20 with the leaf spring battery and cooperating elements about a pivot aligned with its axis, clockwise, if the apparatus is seen as in FIGS. 2 and 4, and fold it back to the position shown in FIG. 4. Said axis is not shown in FIG. 1 and is indicated at 55 in FIGS. 2 to 4. In order to return the apparatus to the operative position of FIG. 2, it suffices to reverse the action of lifting means 40–41 and torque actuator 47.

Figure 2:
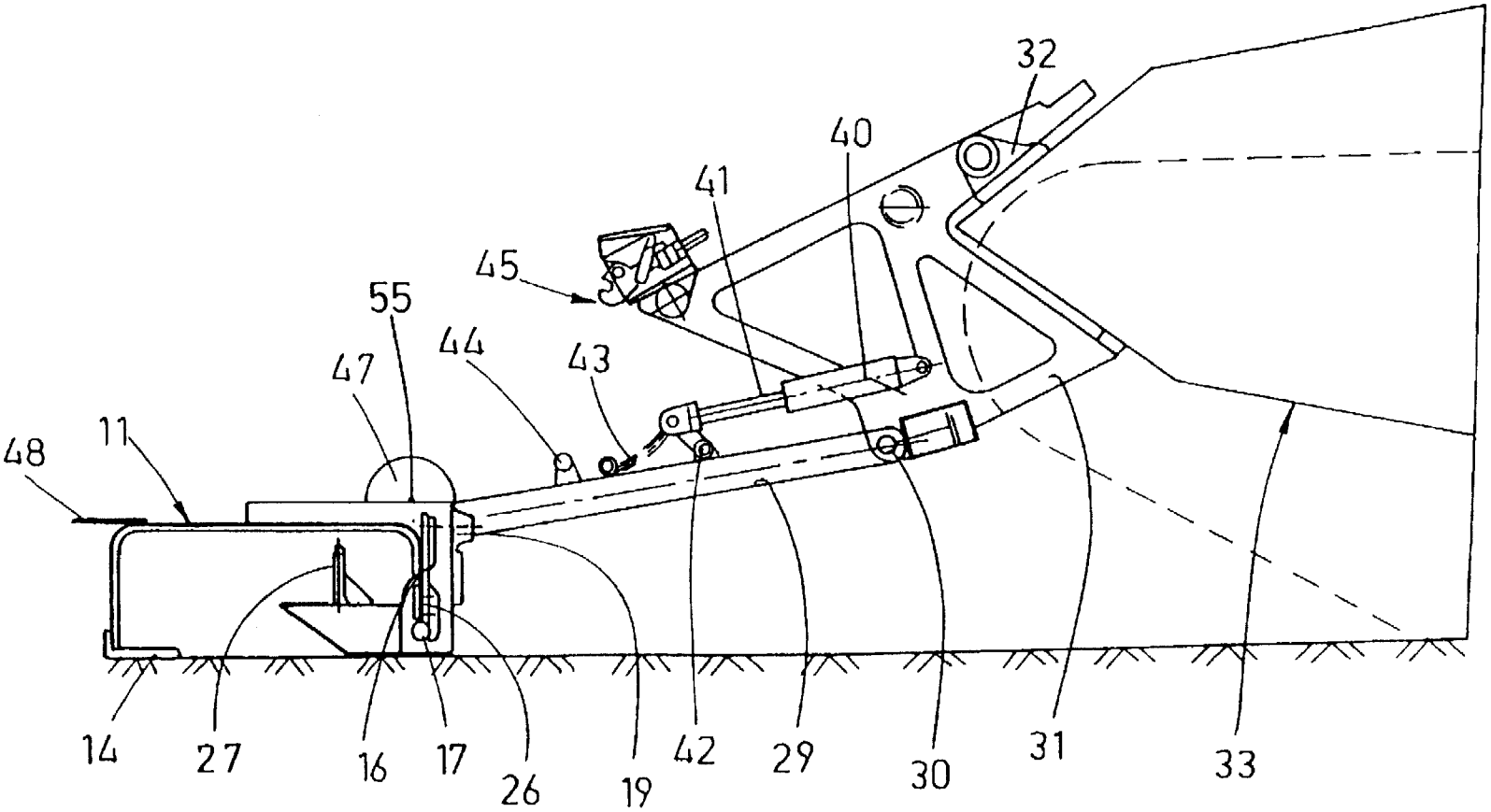
FIG. 2 is a schematic side view of an apparatus according to an embodiment of the invention, including a battery such as that of FIG. 1 and its supporting frame.
Figure 5:
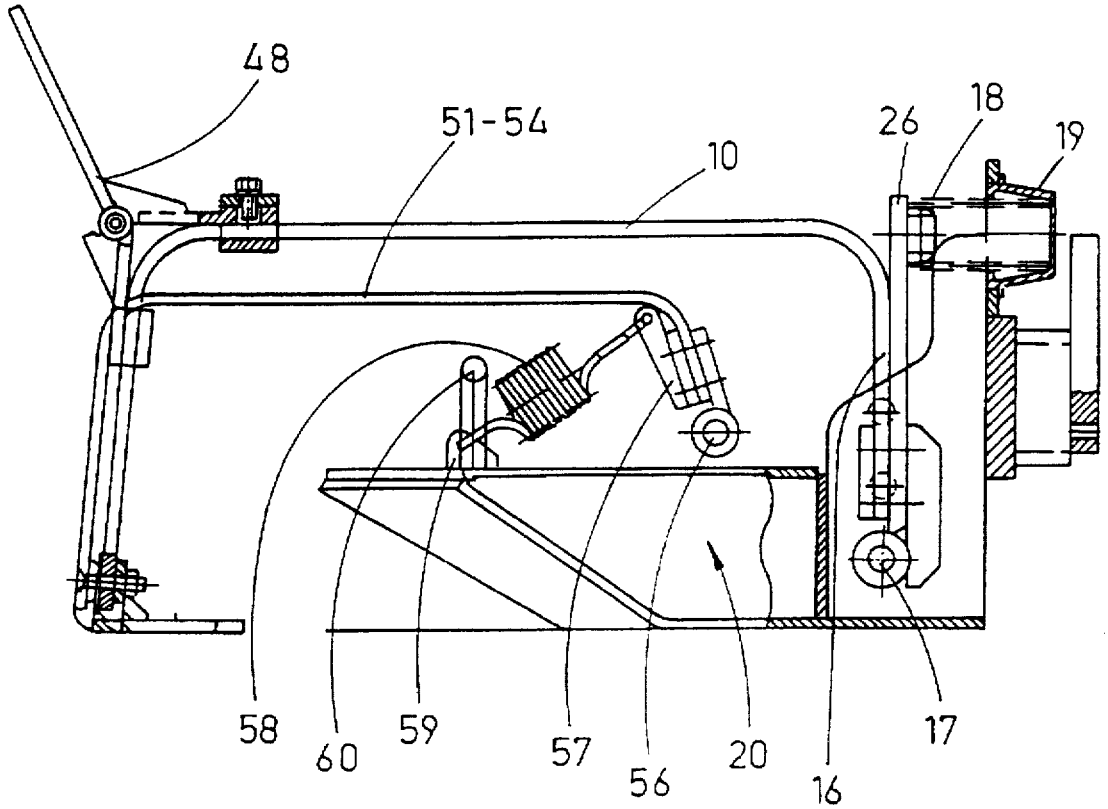
FIG. 5 is a cross-section, at an enlarged scale, of the front portion of the apparatus of FIG. 3, taken through one of the central auxiliary leaf springs.

In the embodiment illustrated, each leaf spring is provided with a deflector 48 (not shown in FIG. 1—see FIGS. 2 and 5). This is a plate as wide as the leaf spring, freely pivoted to this latter approximately above the elbow 15. Normally, the deflector hangs down from its pivot and is inactive. If earth or other material should accumulate in front of the extractor, the deflector will rise, thereby containing it and preventing it from spilling over the leaf spring.

Figure 3:
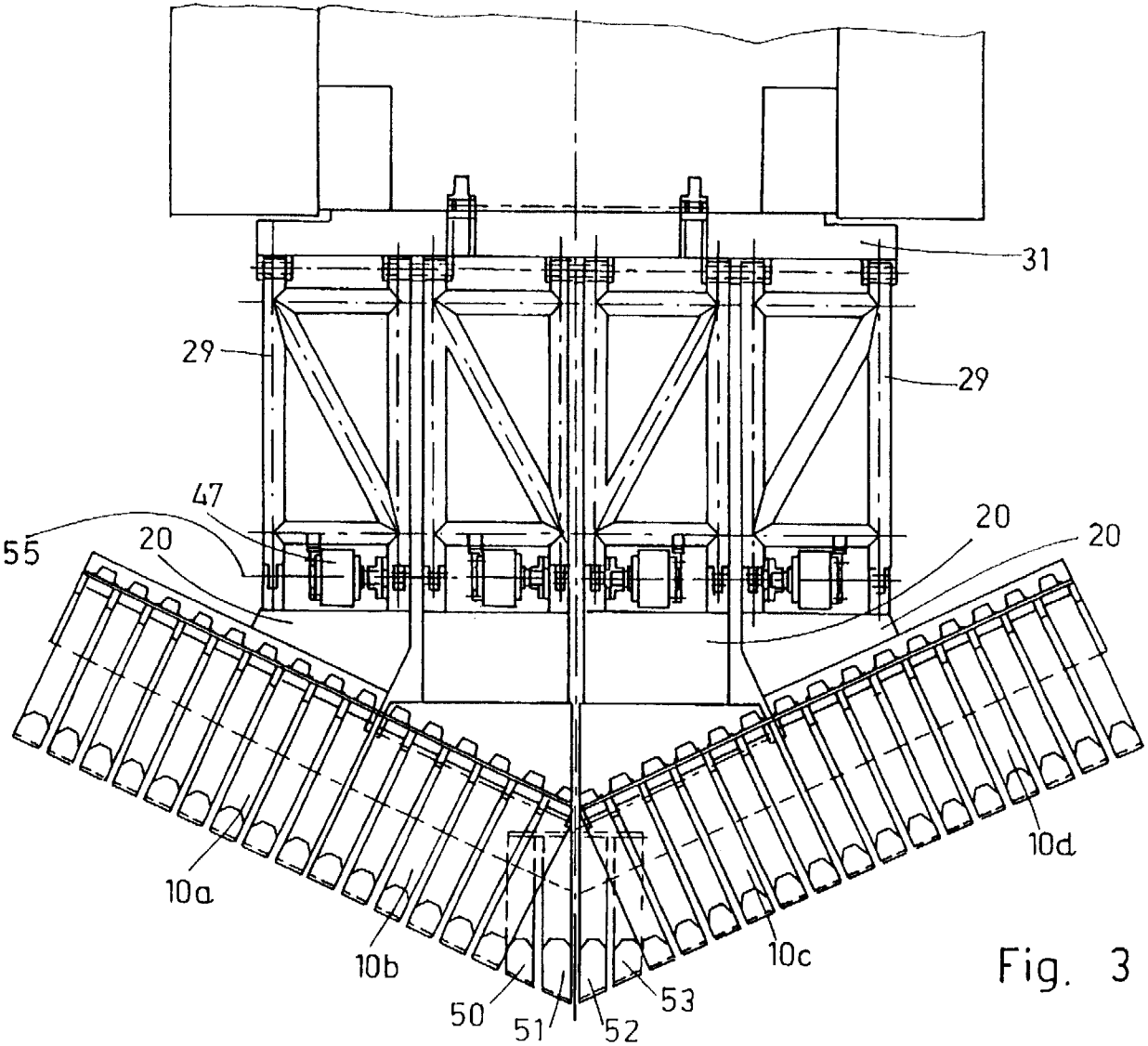
FIG. 3 is a plane view from above of a mine extractor according to an embodiment of the invention, comprising two pairs of batteries of eight leaf springs each and four central auxiliary leaf springs.
Figure 4:
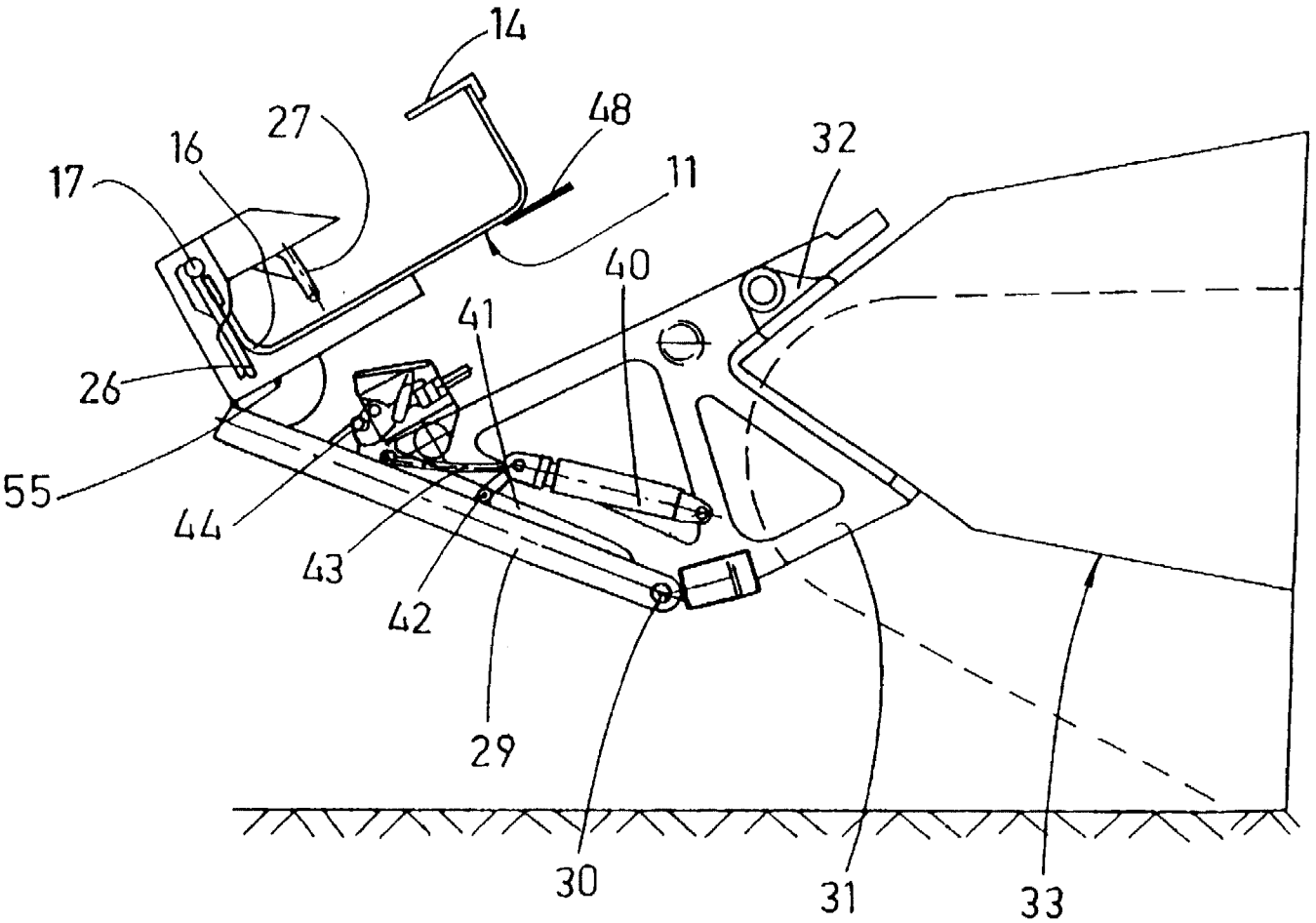
FIG. 4 is a schematic view of the apparatus of FIG. 2, shown in a retracted position for free travel over the ground.

As shown in FIG. 3, several batteries, in any desired number, e.g. four, 10*a*, 10*b*, 10*c* and 10*d*, can be provided at different orientations and mutual angles. In the embodiment of FIG. 3, the batteries are four and each battery is attached to a frame 20-29-31, essentially as hereinbefore described, with the obvious geometric modifications due to the angles between leaf spring batteries. Since in the embodiment described, two batteries, 10*a* and 10*b*, are at an angle with the other two batteries, 10*c* and 10*d*, this would leave an empty space at the center, and therefore auxiliary leaf springs must be provided at the center. In the embodiment described, two such central auxiliary leaf springs, 50–51, are attached to the second battery 10*b*, and two more, 52–53, to the third battery 10*c*, at the end of each battery that is close to the axis of the apparatus. They can be supported on the respective shoes 20 in a manner similar to that of the other leaf springs as particularly illustrated in FIG. 5. In said FIG. 5 the parts already described with respect to the preceding figures are indicated by the same numerals. 51–54 indicates any one of the four central auxiliary leaf springs. This is pivoted at 56 to slide 20. Plates 57 are attached to the leaf spring and to a terminal of a helical spring 58, the other terminal of which is attached to a bracket 59 carried by slide 20. 60 is a vertical stop-plate, similar to and having the same function as stop-plates 27, previously described.

The apparatus according to the invention operates substantially as the known mine extractors when riding over terrain that is free of sharply defined hollows, craters or the like. When the leaf springs 11, with the tip shoes 15, penetrate into a hollow, they will still behave in a like manner, as long as they do not encounter an object that must be extracted, particularly a mine. The elasticity of their connection to the frame permits them to adapt themselves to the hollow and ride out of it. However, when an object such as a mine is encountered, it opposes the forwardly motion of one or more of the leaf springs and a rearwardly directed pressure on the tip of each leaf spring is generated. This, in turn, generates a bending moment about the elbow 15 of the spring, which tends to reduce the angle between the portions 12 and 13 of the spring. The spring will bend, reducing said angle, and this will generate a bending stress and a corresponding bending reaction in said elbow 15. When said stress and reaction become sufficiently great, the leaf spring will snap back, exert a forwardly and upwardly directed force on the mine or other object, and extract it from the hollow. In this way, a novel and more effective way of extracting mines, that have been surface laid in hollows of the ground, has been provided, and a considerable improvement in mine extraction has been achieved. It will be understood, further, that the elastic action of the extractor according to the invention improves it operation on any kind of terrain, in the absence of significant hollows as well, and that while the progress it provides is particularly felt when extracting mines and like objects from hollows, it extends to the whole operation of the extractor apparatus.

As an example, a leaf spring battery such as that of FIG. 1 may comprise leaf springs made of AISI 9260 steel stock, having a thickness between 8 and 12 mm. The width of the springs may be from 95 to 110 mm. The length of the subhorizontal portion may be from 400 to 600 mm, and that of the subvertical portion from 100 to 300 mm. The radius of curvature of the elbow 15 may be from 30 to 60 mm.

While an embodiment of the invention has been described by way of illustration, it will be apparent that the invention may be carried into practice by persons skilled in the art with many modifications, variations and adaptations, particularly with the use of mechanical parts, devices, and arrangements, that are substantially equivalent to those described or that a skilled person is able to provide or devise, based on his knowledge and on the teachings of this specification, within departing from the spirit of the invention or exceeding the scope of the claims.

We claim:

1. Mine extractor comprising.

a frame mountable in front of a vehicle;

at least one battery of leaf springs, the leaf springs being disposed parallel and side-by-side to one another and mounted on a common support, each of said springs having a tip and being so formed and mounted as to slide with the tip on the ground;

means for attaching said battery of leaf springs to the vehicle at desired angles to one another; and said battery of leaf springs being carried by the frame, which comprises a slide, a beam to which said slide is pivotally connected, said beam being pivotally connected to a base.

2. Mine extractor according to claim 1, wherein at least one of the leaf springs is bent at an angle relative to the ground.

3. Mine extractor according to claim 2, wherein the angle is close to a right angle.

4. Mine extractor according to claim 1, wherein at least one of the leaf springs has a rear portion which is attached to the frame, and a front portion, set at an angle with respect to said rear portion.

5. Mine extractor according to claim 1, wherein at least one of the leaf springs has a front portion and a rear portion and, when the mine extractor is operating, the rear portion of the leaf spring is substantially horizontal and the front portion is substantially vertical and downwardly directed.

6. Mine extractor according to claim 1, further comprising elastic means, interposed between at least one of the leaf springs and the frame, for providing an amount of elastic oscillation of said leaf spring with respect to the frame and to the ground.

7. Mine extractor according to claim 6, wherein the elastic means comprises a plurality of spiral springs.

8. Mine extractor according to claim 1, further comprising at least one deflector plate freely pivoted to the respective at least one of the leaf springs about a portion thereof at which the at least one deflector plate is bent at an angle relative to the respective at least one of the leaf springs.

9. Mine extractor according to claim 1, further comprising means for swinging the slide with respect to the beam.

10. Mine extractor according to claim 1, further comprising means for swinging the beam with respect to the base.

11. Mine extractor according to claim 1, further comprising elastic means reacting to angular displacements of the leaf springs with respect to the slide.

12. Mine extractor according to claim 1, further comprising means for limiting downwardly angular displacements of the leaf springs with respect to the slide.

13. Mine extractor, comprising a frame mountable in front of a vehicle;

a plurality of batteries, each battery of which includes a plurality of leaf springs being disposed parallel and side-by-side to one another and mounted on a common support, each of said leaf springs having a tip and being so formed and mounted as to slide with the tip on the ground; and said battery being carried by the frame, which comprises a slide, a beam to which said slide is pivotally connected, said beam being pivotally connected to a base.

14. Mine extractor, comprising a frame mountable in front of a vehicle;

a battery of leaf springs, the leaf springs being disposed parallel and side-by-side to one another and mounted on a common support, each of said springs having a tip and being so formed and mounted as to slide with the tip on the ground;

a slide;

a pivot connection between said battery and said slide; and spring means elastically reacting to oscillations of said battery relative to said slide about said pivot connection.

15. Mine extractor, comprising a frame mountable in front of a vehicle; and a battery of leaf springs, the leaf springs being disposed parallel and side-by-side to one another and mounted on a common support, each of said springs having a tip and being so formed and mounted as to slide with the tip on the ground; and a shoe attached to the tip of each of the leaf springs to protect said tip as said tip slides over the ground.

16. Mine extractor, comprising a frame mountable in front of a vehicle;

a plurality of batteries of leaf springs, each of said batteries including a plurality of leaf springs disposed parallel and side-by-side to one another and mounted on a common support, each of said leaf springs having a tip and being so formed and mounted as to slide with the tip on the ground;

means for attaching said plurality of batteries to the vehicle at desired angles to one another; and auxiliary leaf springs located in a zone where adjacent batteries form an angle to one another.

17. Mine extractor according to claim 16, wherein the auxiliary leaf springs are carried by two batteries forming an angle to one another, at a side of each battery that is adjacent to the other battery, the auxiliary leaf springs are mounted and elastically biased similarly to the plurality of the leaf springs.

18. Mine extractor, comprising a frame mountable in front of a vehicle;

a battery of leaf springs, the leaf springs being disposed parallel and side-by-side to one another and mounted on a common support, each of said springs having a tip and being so formed and mounted as to slide with the tip on the ground;

a slide adapted to slide with its bottom on the ground;

a bar fixed to said slide, each of said leaf springs being pivotally supported for oscillation about said bar;

said slide being attached to a beam, which is pivotally connected to a base; and means for swinging said beam and said slide with respect to said base to lift said slide from the ground.

19. Mine extractor according to claim 18, further comprising means for rotating the slide with the battery to fold the slide back towards the beam.

* * * * *